US010390572B2

(12) United States Patent
Willingham

(10) Patent No.: US 10,390,572 B2
(45) Date of Patent: Aug. 27, 2019

(54) ONE-PIECE SWIMSUIT GARMENT WITH OPENABLE WAIST

(71) Applicant: Angela Willingham, Winder, GA (US)

(72) Inventor: Angela Willingham, Winder, GA (US)

( * ) Notice: Subject to any disclaimer, the term of this patent is extended or adjusted under 35 U.S.C. 154(b) by 13 days.

(21) Appl. No.: 15/589,047

(22) Filed: May 8, 2017

(65) Prior Publication Data

US 2017/0325519 A1 Nov. 16, 2017

Related U.S. Application Data

(60) Provisional application No. 62/391,975, filed on May 16, 2016.

(51) Int. Cl.
*A41D 7/00* (2006.01)

(52) U.S. Cl.
CPC ..... *A41D 7/00* (2013.01); *A41D 2300/322* (2013.01); *A41D 2400/44* (2013.01)

(58) Field of Classification Search
CPC ..... A41D 7/00; A41D 11/00; A41D 15/00; A41D 2300/30; A41D 2300/322; A41D 2300/332; A41D 2400/44; A41B 9/00; A41B 9/005; A41B 9/007; A41B 9/008; A41B 9/08; A41B 13/005; A41B 2300/322; A41B 2300/332; A41B 1/06; A41B 1/10
USPC ..... 2/67, 78.2, 70, 107, 112, 111, 2.15, 2.17
See application file for complete search history.

(56) References Cited

U.S. PATENT DOCUMENTS 286,660 A * 10/1883 Weil ..... A41D 7/00 2/67
310,171 A * 1/1885 Beers ..... A41D 7/00 2/67
601,556 A * 3/1898 Davis ..... A41D 7/00 2/67
1,119,994 A * 12/1914 Shaughnessy ..... A41B 9/08 2/78.2
1,392,303 A * 10/1921 Custer ..... A41D 13/02 2/78.2
1,930,644 A * 10/1933 Daniel ..... A41D 7/00 2/67
1,944,482 A * 1/1934 Winship ..... A41D 7/00 2/404

(Continued)

FOREIGN PATENT DOCUMENTS

GB 384484 A * 12/1932 ..... A41D 7/00

*Primary Examiner* — Amy Vanatta
(74) *Attorney, Agent, or Firm* — Mitch Harris, Atty at Law, LLC; Andrew M. Harris

(57) ABSTRACT

One-piece swimsuit and method of manufacture provide for easy extraction of one or both legs without removing the top of the swimsuit. A top and bottom portion of the swimsuit can be partially separated by an openable closure that connects the top portion to the bottom portion when closed. An integral joining strip that secures the top portion to the bottom portion at one side of the swimsuit, so that when both legs are removed from the bottom portion, the bottom portion of the swimsuit is retained at the side of the wearer. An elastic expansion may be provided in the joining strip to facilitate pulling the bottom portion downward when extracting the wearer's leg(s). The closure may be an elastic band or elastic zipper to facilitate reconnection of the bottom portion to the top portion. A flap or skirt may be included to hide the closure.

19 Claims, 12 Drawing Sheets

(56) References Cited

U.S. PATENT DOCUMENTS 1,969,333 A * 8/1934 Steuer ..... A41D 7/00 2/67
1,998,085 A * 4/1935 Jones ..... A41B 13/00 2/78.2
2,067,870 A * 1/1937 Blackwell ..... A41D 1/00 2/78.2
2,115,833 A * 5/1938 Watinsky ..... A41D 7/00 2/67
2,142,479 A * 1/1939 Rosenfelder ..... A41D 15/00 2/70
2,195,895 A * 4/1940 Moore ..... A44B 19/346 139/384 B
2,612,643 A * 10/1952 Perry ..... A41D 1/00 2/70
2,849,717 A * 9/1958 Klotz ..... A41D 13/02 2/79
2,857,600 A * 10/1958 Finn ..... A41D 7/00 2/67
3,036,574 A * 5/1962 Jeffrey ..... A41D 7/00 2/67
4,301,545 A 11/1981 Camarena
4,656,669 A 4/1987 Beard
4,815,145 A 3/1989 Chow
5,083,316 A * 1/1992 Kuehner ..... A41D 7/00 2/67
5,561,858 A * 10/1996 Poirier ..... A41B 13/00 2/408
6,185,741 B1 2/2001 Kehoe
6,240,560 B1 6/2001 Decaro
6,374,412 B1 * 4/2002 Canlas ..... A41B 9/007 2/67
8,316,464 B2 11/2012 Hersh
9,220,305 B2 12/2015 Hersh
2006/0026734 A1 2/2006 Fitzgerald
2009/0126072 A1 5/2009 Allen
2010/0058508 A1 * 3/2010 Hersh ..... A41D 7/00 2/67
2017/0196283 A1 * 7/2017 Hart ..... A41D 13/0017
2018/0084842 A1 * 3/2018 Pham ..... A41D 7/00
2018/0255853 A1 * 9/2018 Spathas ..... A41D 15/00

* cited by examiner

ONE-PIECE SWIMSUIT GARMENT WITH OPENABLE WAIST

This U.S. Patent Application claims priority under 35 U.S.C. § 119(e) to U.S. Provisional Patent Application Ser. No. 62/391,975 filed on May 16, 2016.

BACKGROUND OF THE INVENTION

1. Field of the Invention

The present invention relates generally to one-piece bathing suits, and more particularly, to a one-piece swimsuit that permits temporary and partial release of a lower portion so that one or both legs can be extracted without removing the swimsuit.

2. Description of the Related Art

One-piece swimsuits are desirable for modesty and fashion. However, a disadvantage of such swimwear is that the entire suit must typically be removed for bathroom visits or other needed exposure of the lower portion of the wearer's torso. Existing solutions involve completely opening or removing the bottom portion of the swimsuit, which while allowing both legs to be freed from the swimsuit, either leaves hanging flaps that are in the front and back of the wearer that will likely contact a toilet, or renders the swimsuit in two pieces, raising the possibility that the two portions will become separated in storage, laundering or when being toted.

Therefore, it would be desirable to have a one-piece swimsuit without detachable portions, but that provides ease of temporary extraction of one or both legs from the bottom portion.

SUMMARY OF THE INVENTION

The above objectives are achieved in a one-piece swimsuit and method of manufacture. The swimsuit includes a top portion, a partially detachable bottom portion, an openable closure that connects the top portion to the bottom portion when closed, and an integral joining strip that secures the top portion to the bottom portion at one side of the swimsuit, so that when both legs are removed from the bottom portion, the bottom portion of the swimsuit is retained at the side of the wearer and remains attached to the top portion of the swimsuit. An elastic expansion may be provided in the integral joining strip to facilitate pulling the bottom portion downward when extracting the wearer's leg and an elastic band or elastic zipper may be used to facilitate the full reconnection of the bottom portion to the top portion. A flap or skirt may be included to hide the closure when the closure is closed.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention includes swimsuits and methods of manufacture of the swimsuits. The swimsuit provides an openable closure that partially separates the top portion and the bottom portion of the swimsuit so that a wearer's leg or legs may be easily extracted, for example during bathroom visits. An integral joining strip joins the bottom portion to the top portion at the side of the swimsuit, so that the swimsuit remains truly a one-piece suit, avoiding separation of the parts of the swimsuit and retaining the bottom portion at the side of the wearer.

Figure 1:
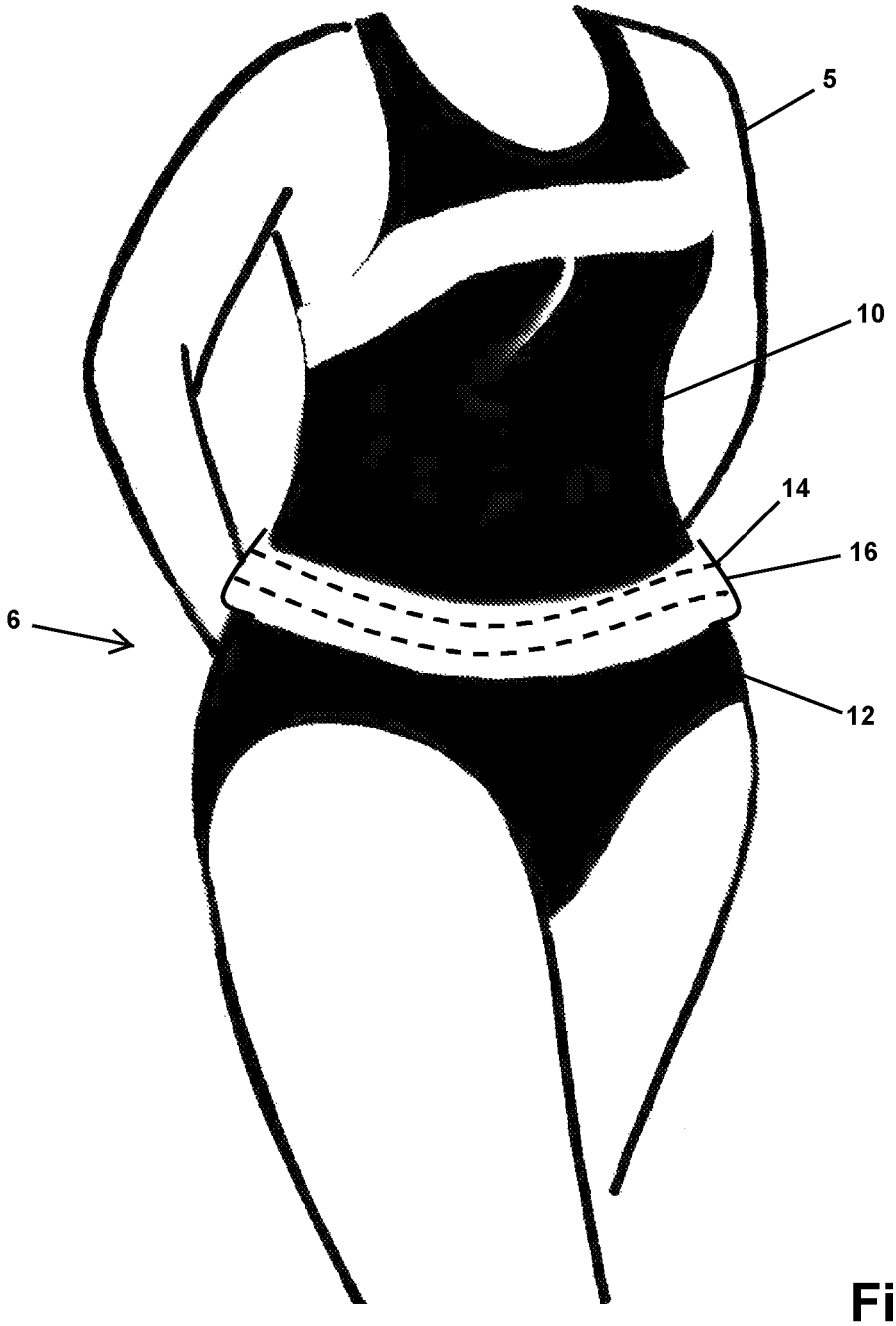
FIG. 1 is a front view showing an example of a swimsuit garment as disclosed herein.

Referring now to FIG. 1, an example swimsuit 6 is shown in accordance with the disclosure herein. The front of swimsuit 6 is shown worn by a wearer 5 and has the appearance of a continuous one-piece swimsuit, with the exception of a flap 14 of material that covers a closure 16, which may be a zipper, button and buttonhole pairs, snaps, or other suitable clothing fastener. Swimsuit 6 has a top portion 10 that covers an upper torso of wearer 5, e.g., the portion of the torso of wearer 5 that lies primarily above the waistline. Swimsuit 6 also has a bottom portion 12 that covers the lower portion of the torso of wearer 5 and extends around the groin of wearer 5.

Figure 2:
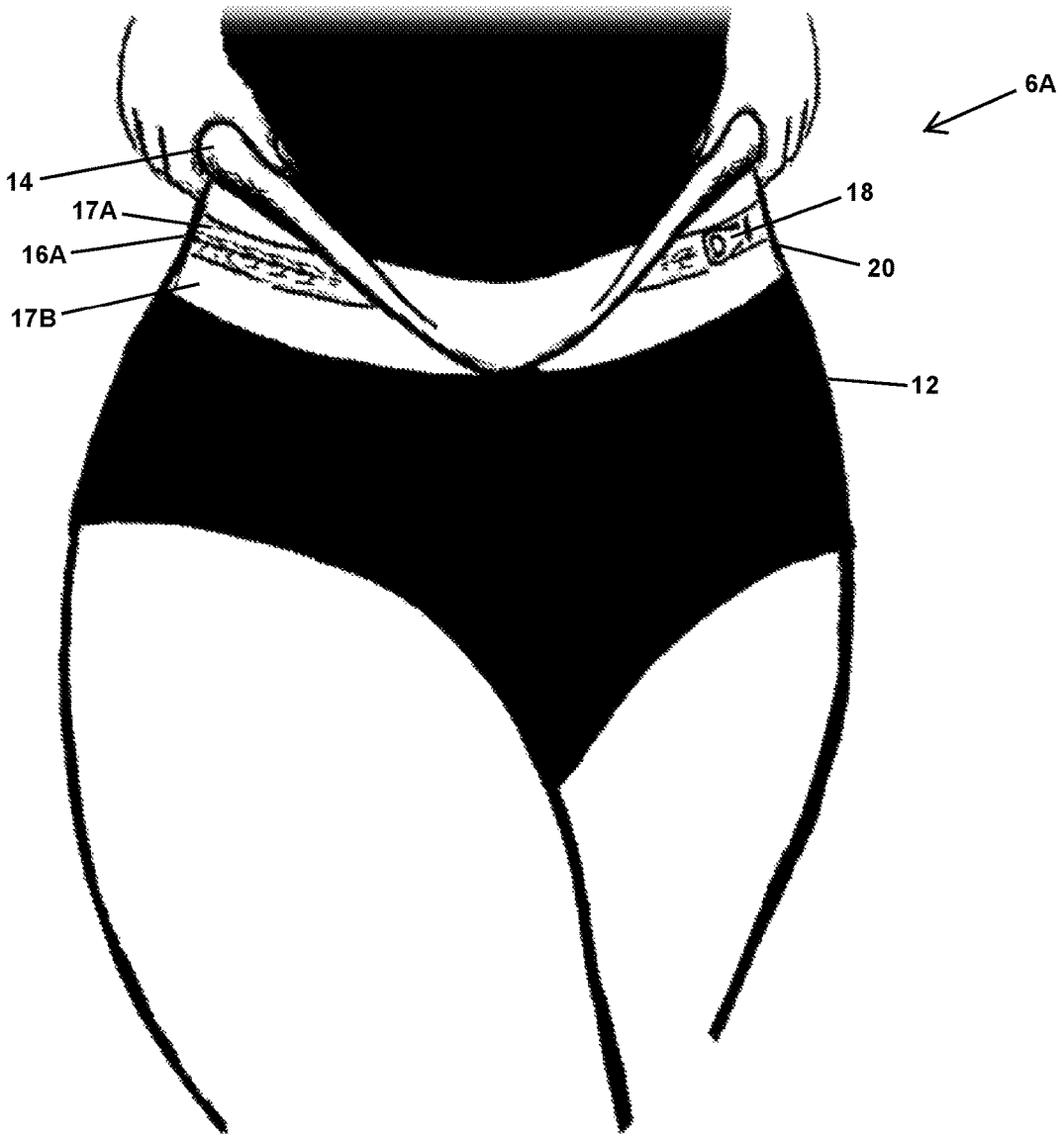
FIG. 2 is a front view showing details of the swimsuit garment of FIG. 1, according to a first example.

Referring now to FIG. 2, further details of flap 14 and closure 16 in a front view of a swimsuit 6A are shown, that is an example of swimsuit 6 as shown in FIG. 1, with flap 14 in a partially raised position. The termination of a closure 16A is located at a left side of wearer 5 and a joining strip 20 connects top portion 10 with bottom portion 12 at the left side of wearer 5 (right side of FIG. 2) so that top portion 10 cannot be completely separated from bottom portion 12, i.e., bottom portion 12 cannot fall off or be misplaced when closure 16A is fully opened. Joining strip 20 may preferably be made from an elastic material, as will be described in further detail below, or may be a pre-fabricated elastic band. Joining strip 20, in the example, is 3 inches long. Closure 16A is illustrated as a zipper with a pull tab 18 and extends around the back of swimsuit 6A to reach a back side of joining strip 20, so that bottom portion 12 can be temporarily separated from top portion 10 when making a bathroom visit, when dressing, or when it is otherwise desirable to separate top portion 10 from bottom portion 12, permitting the easy extraction of one or both legs of wearer 5 from bottom portion 12, while top portion 10 remains in-place. A first zipper portion 17A of closure 16A, which is the upper toothed fabric strip of a zipper, is attached to a bottom edge of top portion 10 of swimsuit 6A and a second zipper portion 17B of closure 16A, which is the lower toothed fabric strip of a zipper, is attached to a top edge of bottom portion 12 of swimsuit 16A. Closure 16A may preferably be an elastic zipper, in which the toothed fabric strips are formed from an elastic material, but as illustrated below, may alternatively be a zipper formed from non-elastic material with elastic otherwise integrated in a zipper assembly. The zipper, whether elastic or non-elastic, may have an end stop that is not separable, since joining strip 20 prevents complete separation of zipper portions 17A and 17B, and it may be inconvenient to reconnect a separable end when closing closure 16A. The zipper should be made of non-rusting and chlorine/salt-resistant material, such as nylon, another plastic, or stainless steel.

Figure 3:
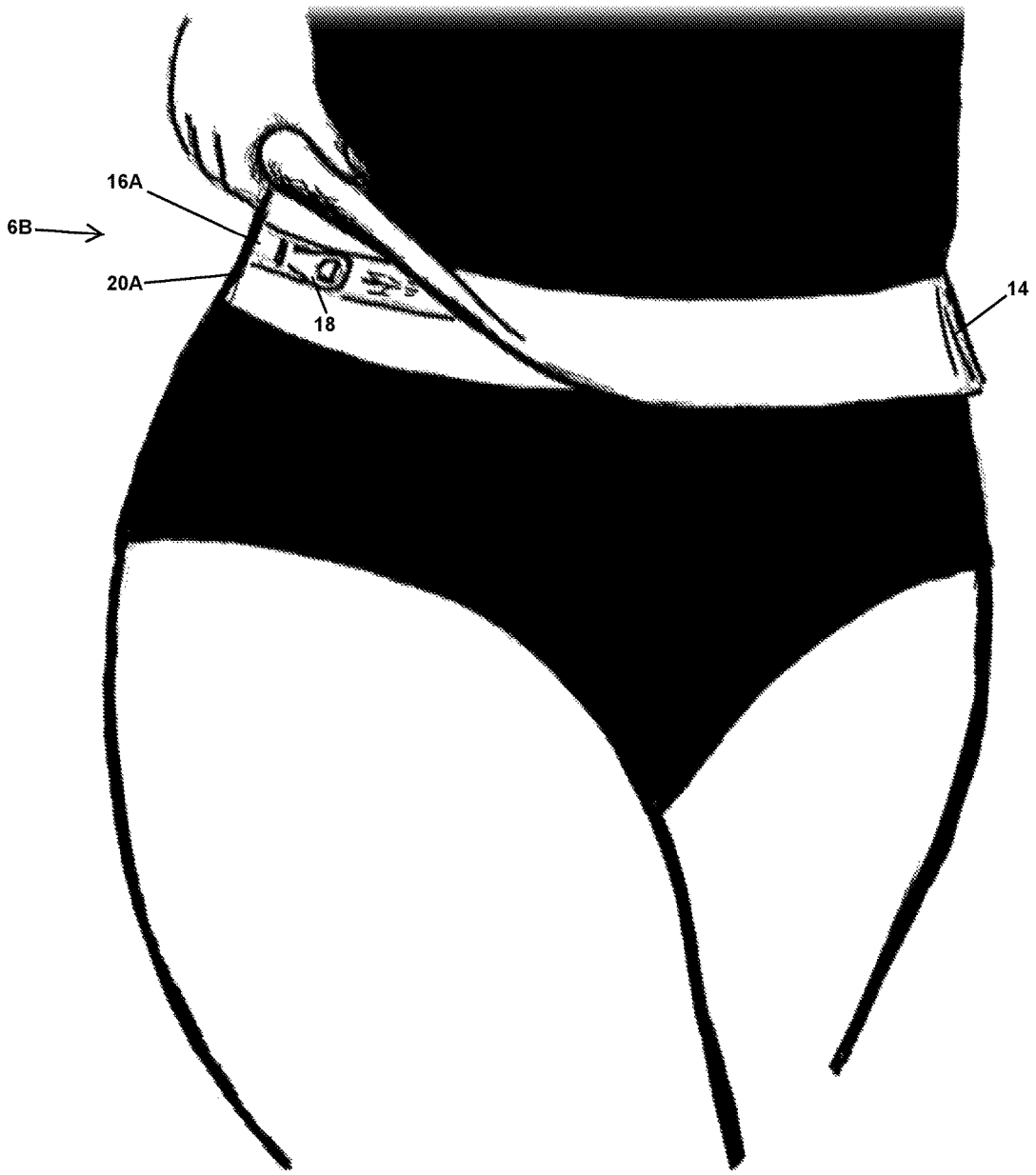
FIG. 3 is a front view showing details of the swimsuit garment of FIG. 1, according to a second example.

Referring now to FIG. 3, another example swimsuit 6B is shown, which is another example of swimsuit 6 as illustrated in FIG. 1. Swimsuit 6B is similar to swimsuit 6A of FIG. 2, with the only difference being the location of a joining strip 20A at the right side of wearer 5 and the orientation of closure 16A with pull tab 18 oriented to operate in a reverse direction with respect to the example of FIG. 2.

Figure 4:
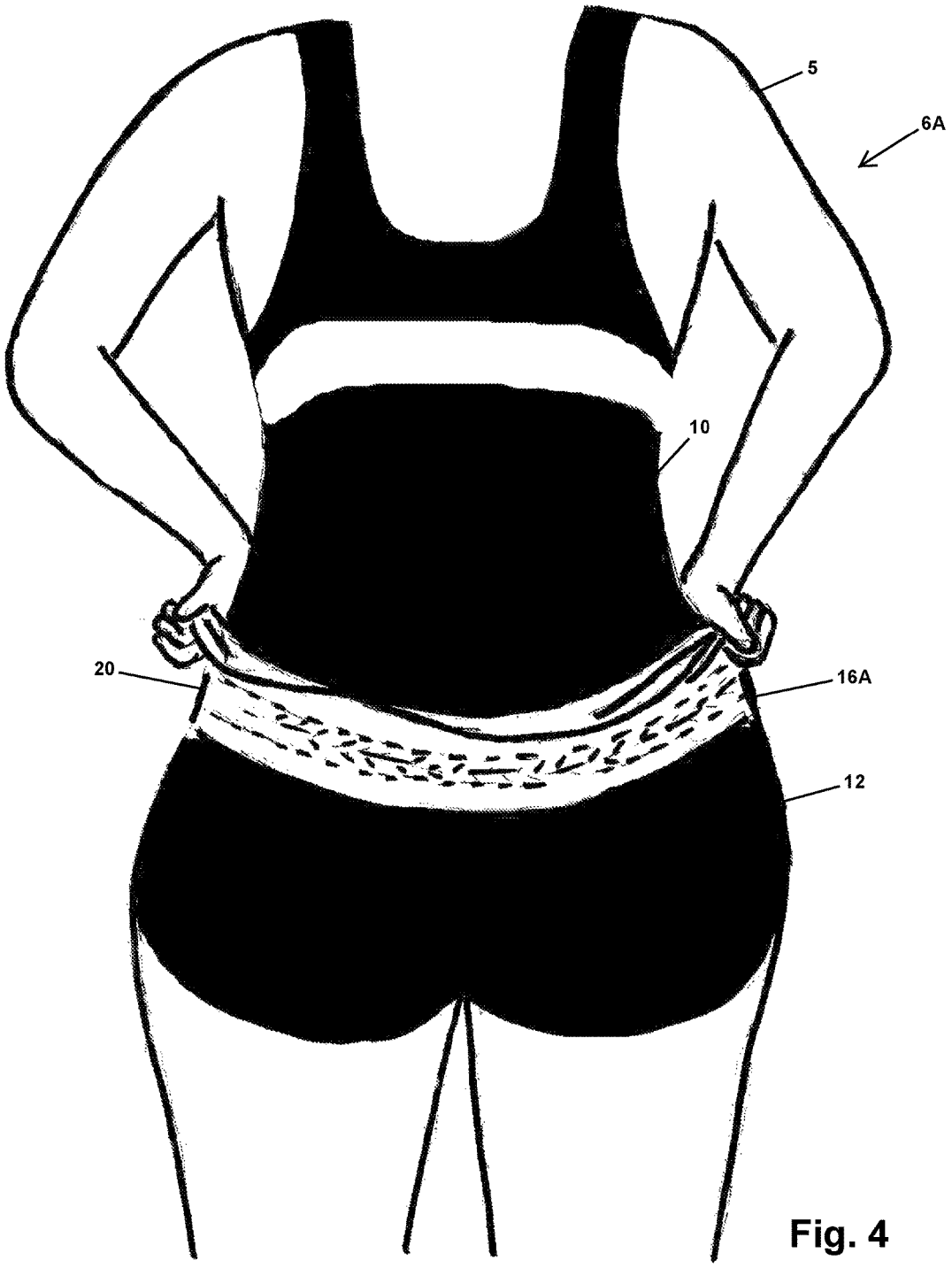
FIG. 4 is a rear view of the swimsuit garment of FIG. 1.

Referring now to FIG. 4, a back side of swimsuit 6A of FIG. 2 is shown with a back view of wearer 5. As shown, joining strip 20 lies at the left side of wearer 5 (left side of FIG. 4), with closure 16A extending around the back side of wearer 5 to join top portion 10 and bottom portion 12.

Figure 5:
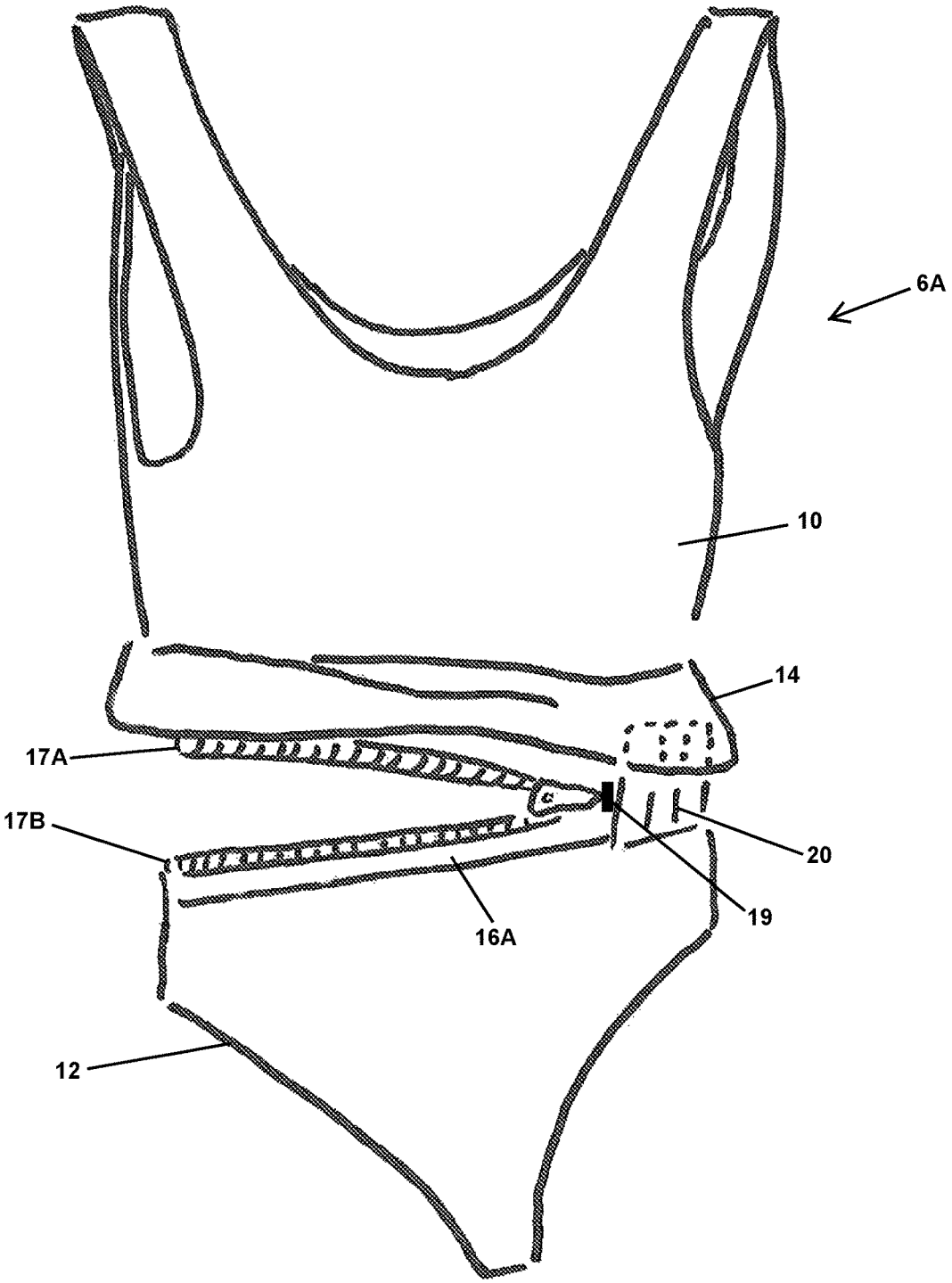
FIG. 5 is a front view showing further details of the swimsuit garment of FIG. 1 and FIG. 2.
Figure 6:
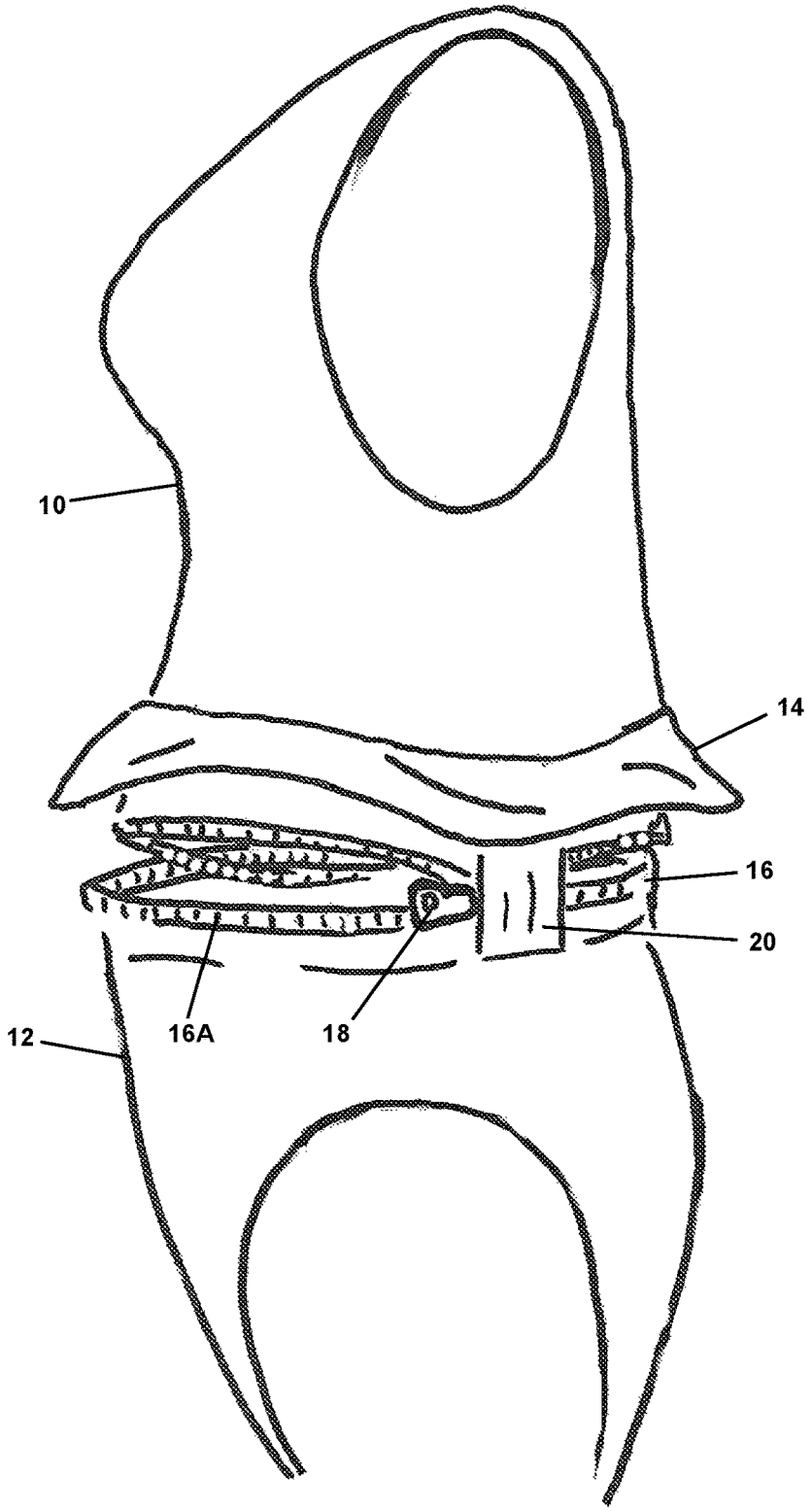
FIG. 6 is a side view showing further details of the swimsuit garment of FIG. 5.
Figure 7:
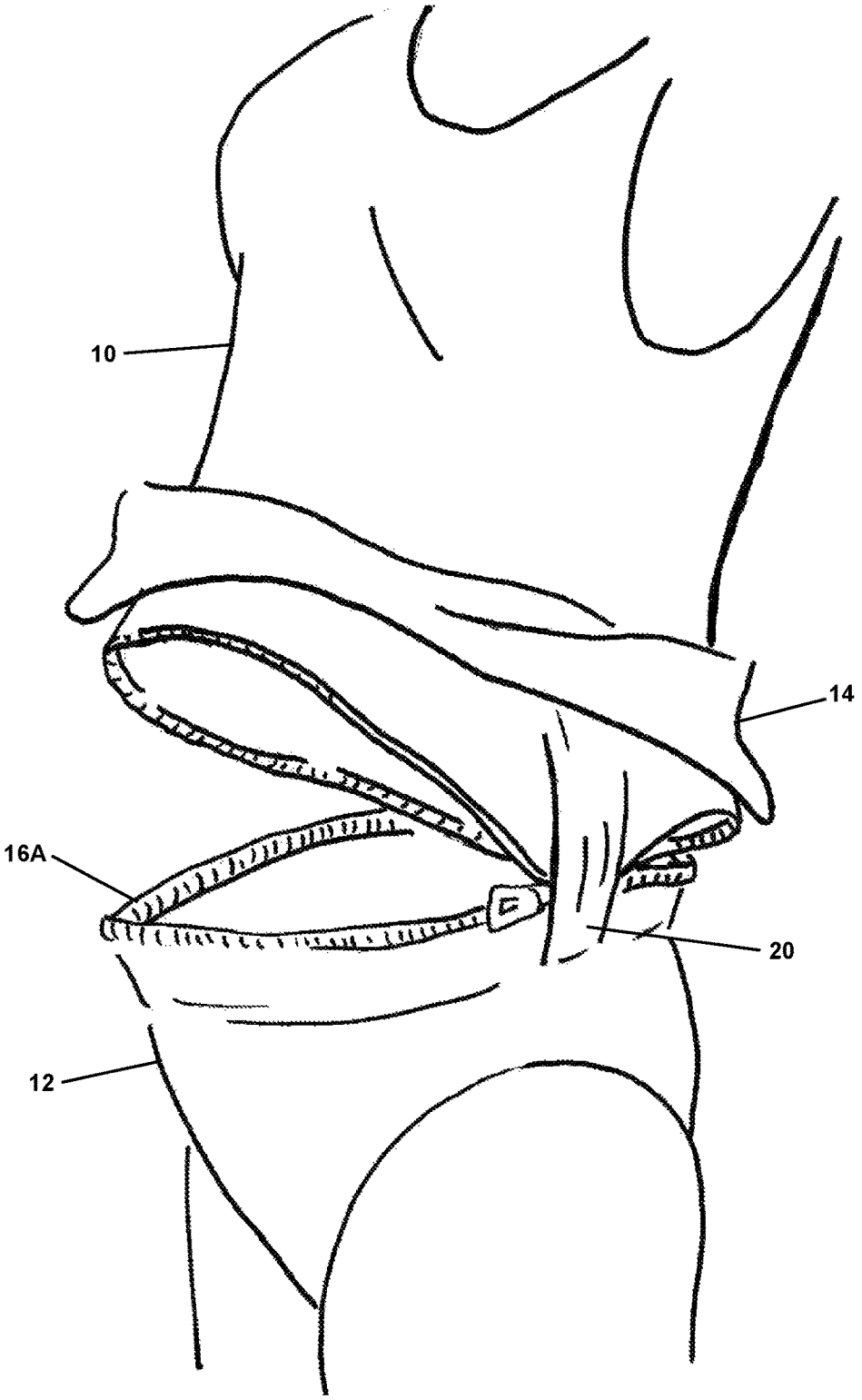
FIG. 7 is a perspective view showing further details of the swimsuit garment of FIG. 5.

Referring now to FIG. 5, a front view of swimsuit 6A of FIG. 2 is shown with closure 16A fully open, i.e., first zipper portion 17A of closure 16A has been fully separated from second zipper portion 17B of closure 16A, with the exception of an end stop 19 located adjacent to joining strip 20. Opening closure 16A permits separation of top portion 10 and bottom portion 12, as illustrated, and bottom portion 12 may then be pulled down to extract the right leg of wearer 5 and optionally the left leg of wearer 5, with bottom portion 12 still retained to top portion 10 by joining strip 20. Use of an elastic construction for joining strip 20 permits bottom portion 12 to be pulled further down, and if non-elastic construction is used for closure 16A it may be desirable to use a zipper with first and second zipper portions 17A, 17B separable at end stop 19, so that joining strip 20 can be stretched. FIG. 6 shows a side view of swimsuit 6A of FIG. 2 with closure 16A fully open, but not separated. FIG. 7 shows a side view of swimsuit 6A of FIG. 2 with closure 16A separated and joining strip 20 partially stretched to separate bottom portion 12 from top portion 10.

Figure 8:
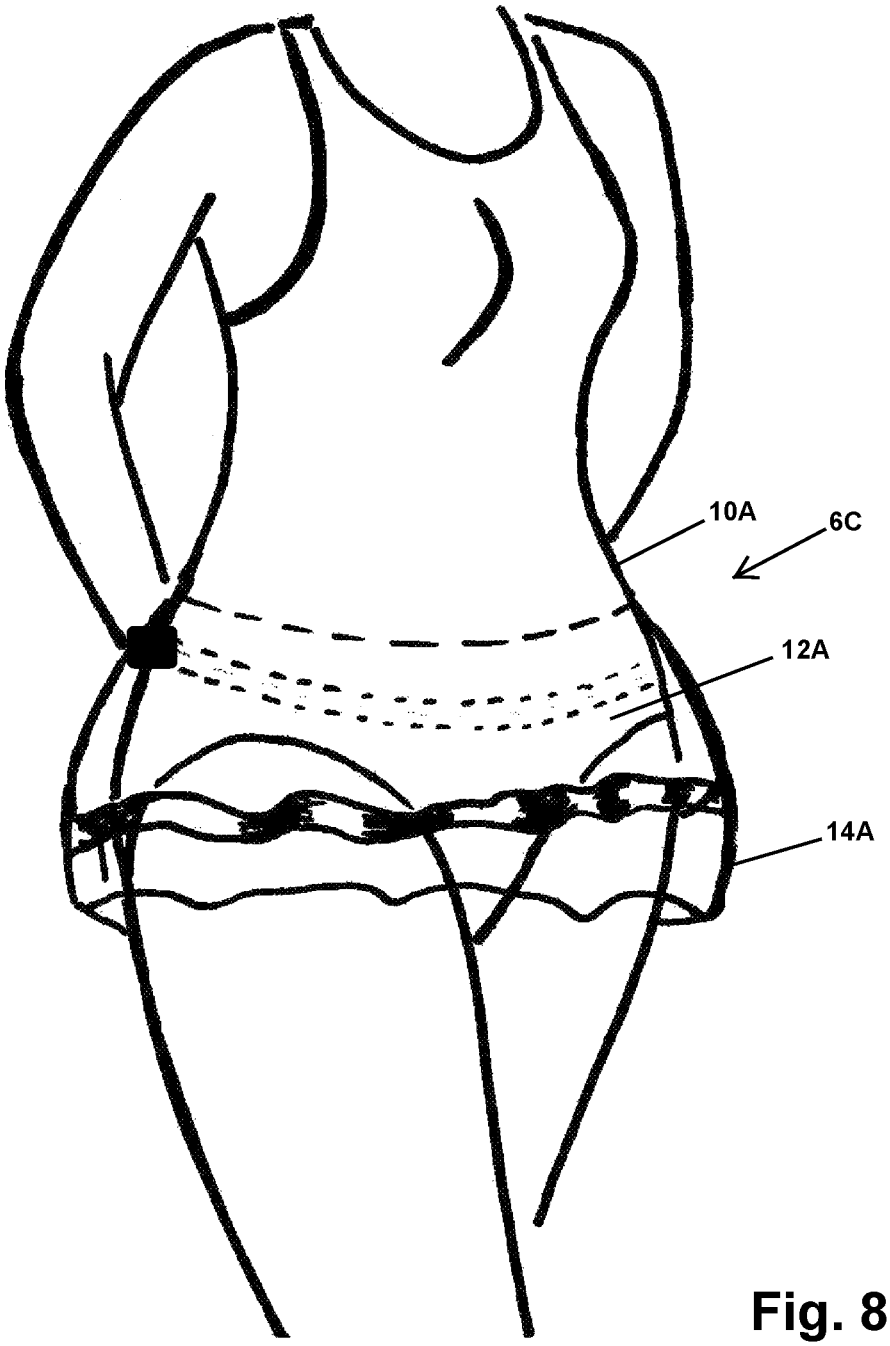
FIG. 8 is a front view showing an example of another swimsuit garment as disclosed herein.
Figure 9:
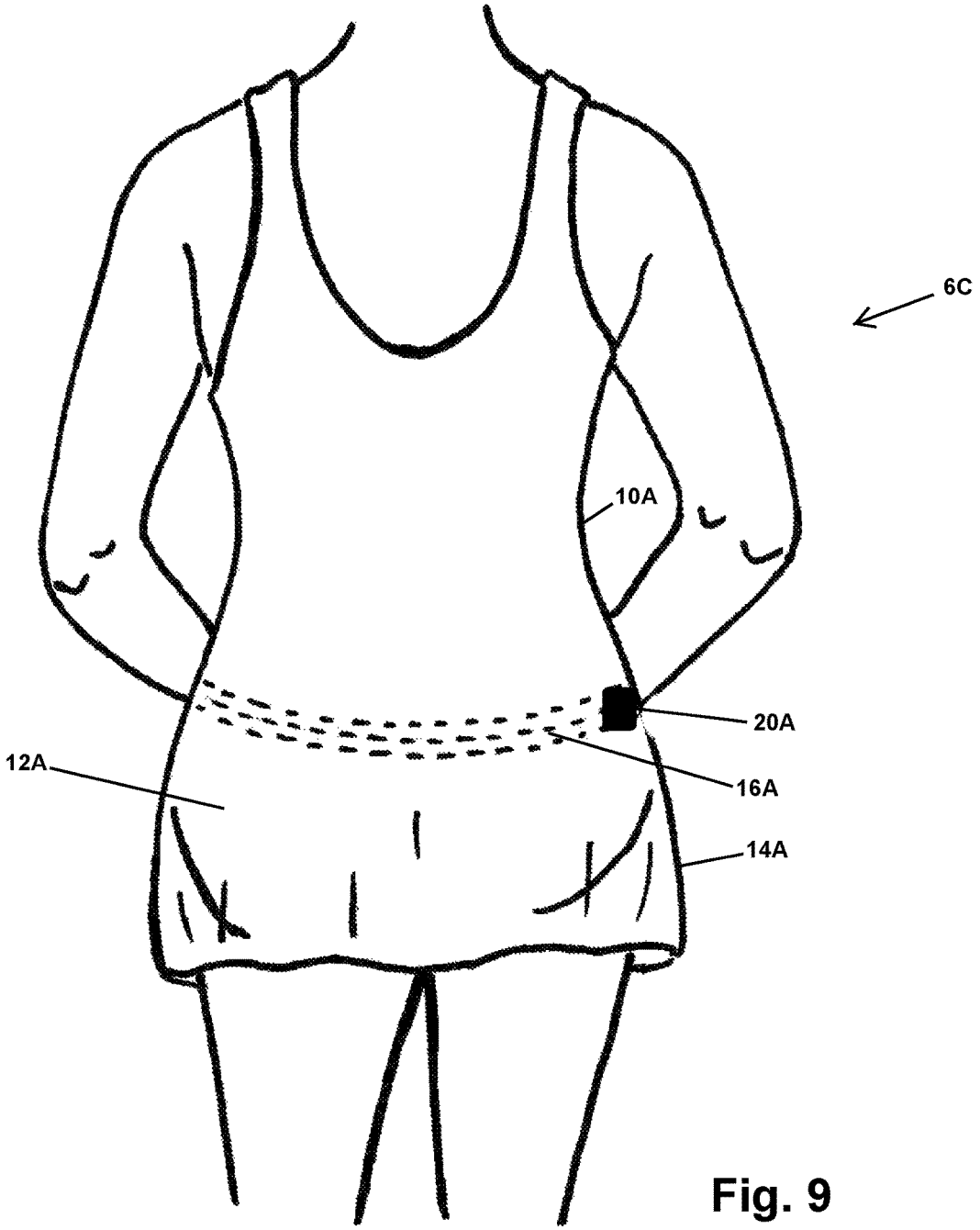
FIG. 9 and FIG. 10 are rear views of the swimsuit garment of FIG. 8.
Figure 10:
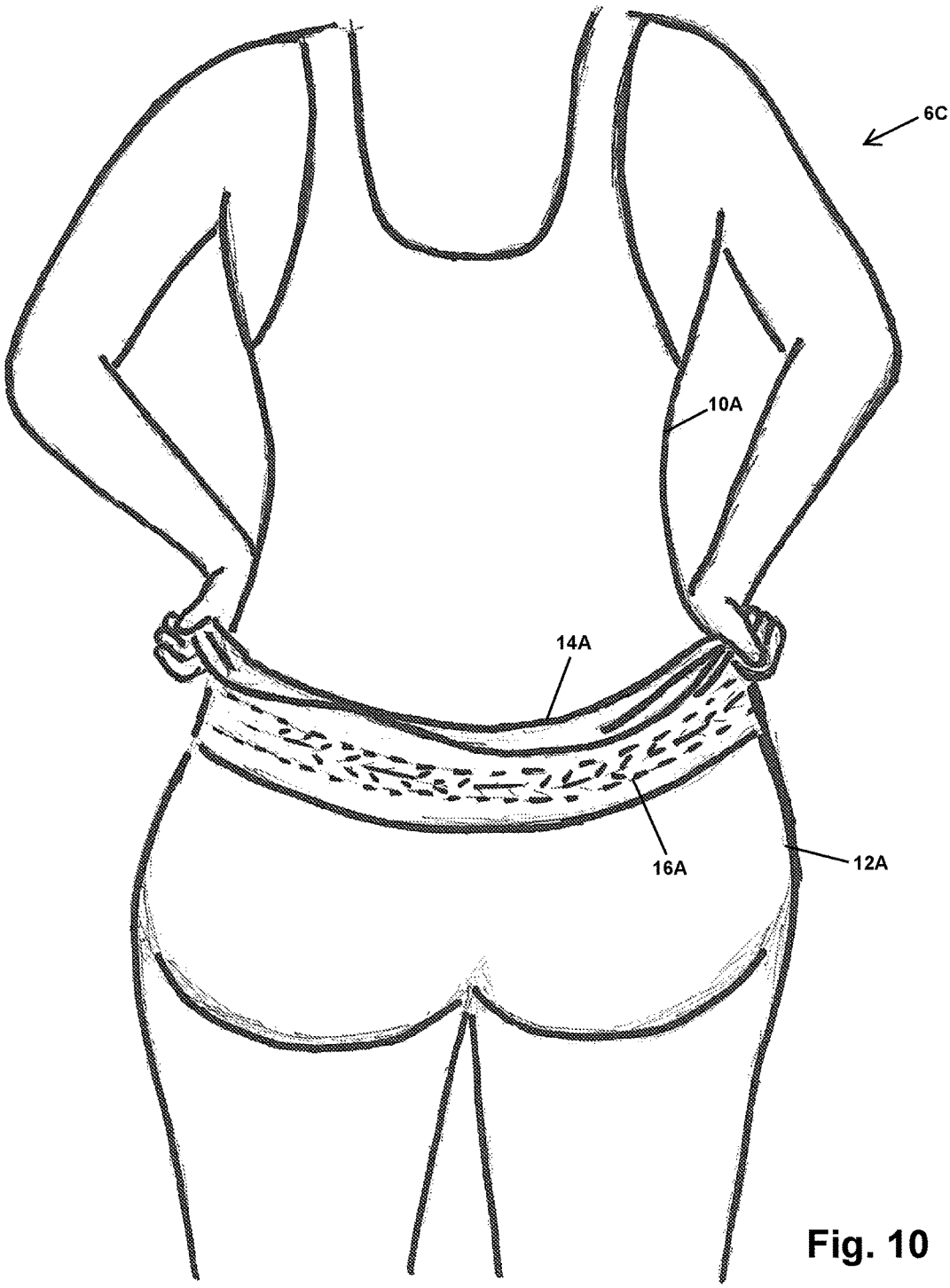

Referring now to FIG. 8, a front view of another example swimsuit 6C is shown. Swimsuit 6C is similar to the above-described swimsuits 6, 6A and 6B, with an elongated flap 14A forming a skirt that covers most or all of a bottom portion 12A, i.e., the length of flap 14A is such that flap 14A extends to a length near the bottom of bottom portion 12A. The upper edge of flap 14A may commence at a height along a top portion 10A of swimsuit 6C that is greater than that of flap 14 in the earlier examples, as flap 14A is intended to provide an aesthetic present in skirted swimsuits. FIG. 9 shows a back view of swimsuit 6C of FIG. 8 with flap 14A fully draped to form a skirt and FIG. 10 shows a back view of swimsuit 6C with flap 14A pulled up to expose closure 16A.

Figure 11:
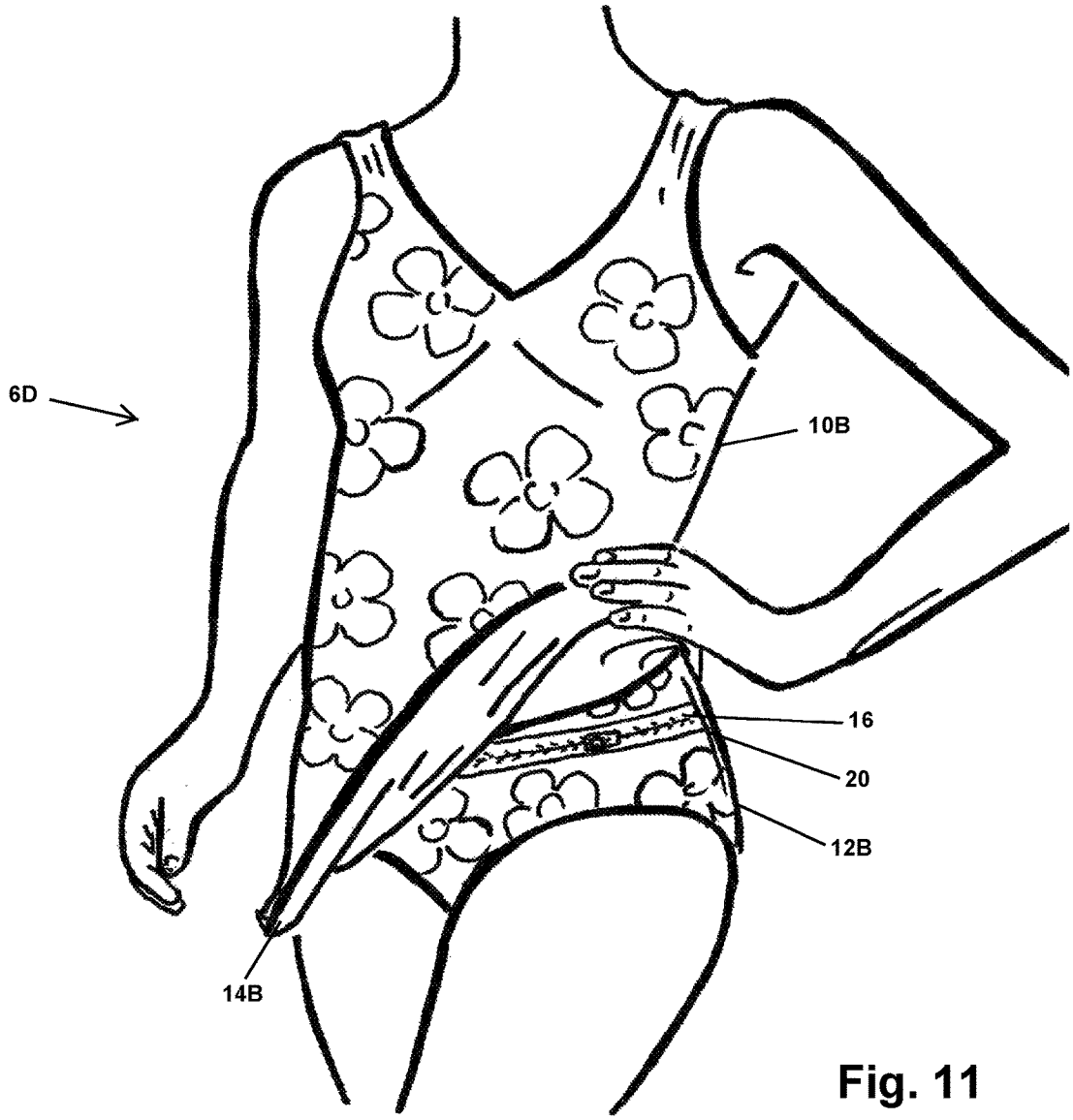
FIG. 11 is a front view showing an example of yet another swimsuit garment as disclosed herein.

Referring now to FIG. 11, a perspective view of another example swimsuit 6D is shown. Swimsuit 6D is similar to the above-described swimsuit 6C, except that a cover portion 14B of swimsuit 6D provides the aesthetic of a double-layer skirted one-piece swimsuit, with cover portion 14B also providing the flap that hides closure 16 and joining strip 20. As such, a top portion 10B of swimsuit 6D is covered by and co-joins cover portion 14B for at least part of the extent of top portion 10B. Cover portion 14B also extends downward to cover all or most of a bottom portion 12B of swimsuit 6D.

Figure 12:
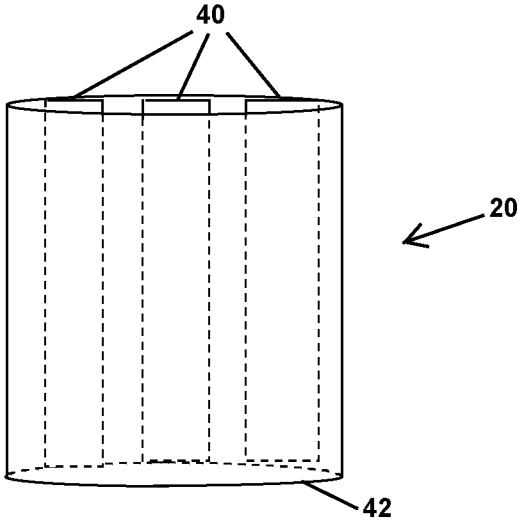
FIG. 12 is a side view showing details of joining strip 20 of FIG. 2 that can also be used to implement joining strip 20A of FIG. 3.

Referring now to FIG. 12, construction details of joining strip 20 (which may be made identically to joining strip 20A in FIG. 3) are shown. A tube 42 of fabric is generally the same fabric used to form swimsuits 6 and 6A-6D, but alternatively may be a matching fabric with a more elastic property or in the case of a joining strip 20 that is completely hidden by one of flaps 14, 14A, or cover portion 14B, may be made of a non-matching fabric or elastic band. Within tube 42, one or more elastic bands, cords or strips 40 may be included and sewn to at least an inner surface of tube 42. Generally, in the case of cords, the sewing may be around the edges of elastic cords 40 to permit them to move within tube 42.

Figure 13:
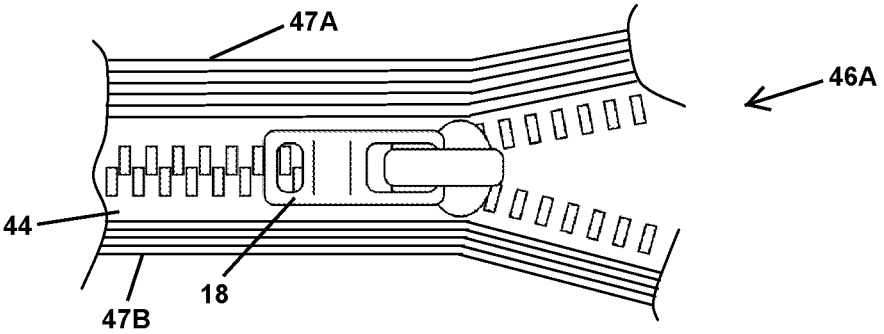
FIG. 13 is a front view showing details of an elastic zipper that can be used in swimsuit 6 of FIG. 1.

Referring now to FIG. 13, construction details of a closure 46A which can be used to provide closures 16, 16A in the examples described above, are shown. Closure 46A is an elastic zipper, i.e., a zipper in which a top toothed portion 47A and a bottom toothed portion 47B are made from an elastic material 44 and joined by pull tab 18, so that closure 46A provides ease, especially when re-closing closure 46A.

Figure 14:
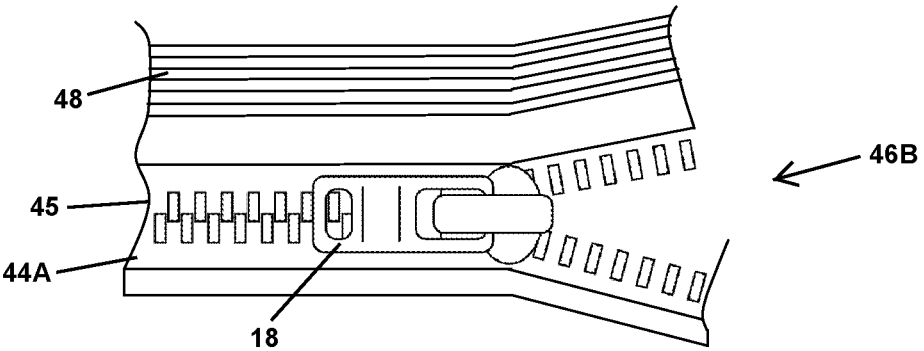
FIG. 14 is a front view showing details of a zipper assembly that can be used in swimsuit 6 of FIG. 1.

Referring now to FIG. 14, construction details of an alternative closure 46B which can be used to provide closures 16, 16A in the examples described above, are shown. Closure 46B includes a non-elastic zipper 45, i.e., a zipper made from a non-elastic material 44A and joined by pull tab 18. A separate elastic strip 48 is sewn to the upper or lower toothed portion of non-elastic zipper 45, so that closure 46B provides ease.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A swimsuit garment, comprising:

a top portion for substantially covering a torso of a wearer above a waistline of the wearer;

a bottom portion for substantially covering the torso of the wearer below the waistline of the wearer;

a closure for securing the top portion to the bottom portion around the waistline of the wearer, wherein the closure extends only partially around a waistline of the swimsuit garment and is openable to separate the top portion and the bottom portion along a first side of the swimsuit garment and a front and a back of the swimsuit garment; and a joining strip securing the bottom portion to the top portion and positioned along the waistline at a second side of the swimsuit garment, whereby the top portion and the bottom portion are permanently secured together irrespective of whether the closure is closed, wherein the joining strip comprises a tube formed from a same material as a material from which the top portion and the bottom portion are formed and sewn to the top portion at a first end thereof and to the bottom portion at a second end thereof, and one or more elastic bands or cords sewn to or within an inner surface of the tube.

2. The swimsuit garment of claim 1, wherein the closure is a zipper having a first toothed portion attached to a bottom edge of the top portion and a second toothed portion attached to a top edge of the bottom portion.

3. The swimsuit garment of claim 2, wherein the zipper has an end stop that is not separable.

4. The swimsuit garment of claim 3, wherein the zipper is an elastic zipper formed from teeth attached to strips of an elastic material.

5. The swimsuit garment of claim 3, wherein the zipper forms part of a zipper assembly, comprising:

a non-elastic zipper having first and second non-elastic tape portions; and at least one strip of elastic material attached between either the first tape portion and the bottom edge of the top portion of the swimsuit or the second tape portion and the top edge of the bottom portion.

6. The swimsuit garment of claim 1, further comprising a flap of material extending around a bottom edge of the top portion, wherein the flap of material is configured to hang downwards to extend below a top edge of the bottom portion to cover the closure when the closure is closed.

7. The swimsuit garment of claim 6, wherein the flap of material has a width so as to form a skirt that extends to a bottom end of the bottom portion.

8. The swimsuit garment of claim 6, wherein the flap of material has a width extending just below the top edge of the bottom portion.

9. The swimsuit garment of claim 1, further comprising a cover portion of the swimsuit attached to the top portion, wherein the cover portion covers the closure when draped over the top portion and at least part of the bottom portion of the swimsuit.

10. A method of manufacturing a swimsuit garment, comprising:

fabricating a top portion for substantially covering a torso of a wearer above a waistline of the wearer;

fabricating a bottom portion for substantially covering the torso of the wearer below the waistline of the wearer;

attaching a closure to both the top portion and the bottom portion for securing the top portion to the bottom portion around the waistline of the wearer, wherein the closure extends only partially around a waistline of the swimsuit garment and is openable to separate the top portion and the bottom portion along a first side of the swimsuit garment and a front and a back of the swimsuit garment;

forming the joining strip from a tube of a same material as a material from which the top portion and the bottom portion are formed and sewing one or more elastic bands or cords to or within an inner surface of the tube; and attaching the joining strip between the bottom portion and the top portion positioned along the waistline at a second side of the garment by sewing a first end of the tube to the top portion and a second end of the tube to the bottom portion, whereby the top portion and the bottom portion are permanently secured together irrespective of whether the closure is closed.

11. The method of claim 10, wherein the attaching a closure attaches a first toothed portion of a zipper to a bottom edge of the top portion and a second toothed portion of a zipper to a top edge of the bottom portion.

12. The method of claim 11, wherein the zipper has an end stop that is not separable.

13. The method of claim 12, wherein the zipper is an elastic zipper formed from teeth attached to strips of an elastic material.

14. The method of claim 12, wherein the attaching a closure comprises:

attaching a non-elastic zipper having first and second non-elastic tape portions by attaching the first non-elastic tape portion to a first of the bottom edge of the top portion of the swimsuit or the top edge of the bottom portion of the swimsuit; and attaching at least one strip of elastic material between the second non-elastic tape portion and a second one of the bottom edge of the top portion of the swimsuit or the top edge of the bottom portion of the swimsuit.

15. The method of claim 10, further comprising attaching a flap of material to the top portion of the swimsuit and extending around a bottom edge of the top portion, wherein the flap of material is configured to hang downwards to extend below a top edge of the bottom portion to cover the closure when the closure is closed.

16. The method of claim 15, wherein the flap of material has a width extending just below the top edge of the bottom portion.

17. The method of claim 10, further comprising attaching a cover portion of the swimsuit to the top portion, wherein the cover portion covers the closure when draped over the top portion and at least part of the bottom portion of the swimsuit.

18. A swimsuit garment, comprising:

a top portion for substantially covering a torso of a wearer above a waistline of the wearer;

a bottom portion for substantially covering the torso of the wearer below the waistline of the wearer;

a closure for securing the top portion to the bottom portion around the waistline of the wearer, wherein the closure extends only partially around a waistline of the swimsuit garment and is openable to separate the top portion and the bottom portion along a first side of the swimsuit garment and a front and a back of the swimsuit garment;

a joining strip securing the bottom portion to the top portion and positioned along the waistline at a second side of the swimsuit garment, whereby the top portion and the bottom portion are permanently secured together irrespective of whether the closure is closed; and a flap of material extending around a bottom edge of the top portion, wherein the flap of material is configured to hang downwards to extend below a top edge of the bottom portion to cover the closure when the closure is closed, wherein the flap of material has a width so as to form a skirt that extends to a bottom end of the bottom portion.

19. A method of manufacturing a swimsuit garment, comprising:

fabricating a top portion for substantially covering a torso of a wearer above a waistline of the wearer;

fabricating a bottom portion for substantially covering the torso of the wearer below the waistline of the wearer;

attaching a closure to both the top portion and the bottom portion for securing the top portion to the bottom portion around a waistline of the wearer, wherein the closure extends only partially around a waistline of the swimsuit garment and is openable to separate the top portion and the bottom portion along a first side of the swimsuit garment and a front and a back of the swimsuit garment;

attaching a joining strip between the bottom portion and the top portion positioned along the waistline at a second side of the wearer, whereby the top portion and the bottom portion are permanently secured together irrespective of whether the closure is closed; and attaching a flap of material to the top portion of the swimsuit and extending around a bottom edge of the top portion, wherein the flap of material is configured to hang downwards to extend below a top edge of the bottom portion to cover the closure when the closure is closed, and wherein the flap of material has a width so as to form a skirt that extends to a bottom end of the bottom portion.

* * * * *